US005342225A

United States Patent [19]

Farr

[11] Patent Number: 5,342,225

[45] Date of Patent: Aug. 30, 1994

[54] ELECTRICAL CONNECTOR FOR PYROTECHNIC APPLICATIONS

[75] Inventor: Raymond C. Farr, Azusa, Calif.

[73] Assignee: The Walt Disney Company, Burbank, Calif.

[21] Appl. No.: 71,667

[22] Filed: Jun. 2, 1993

[51] Int. Cl.[5] ..... H01R 4/48

[52] U.S. Cl. ..... 439/817; 439/840

[58] Field of Search ..... 439/778, 779, 781, 782, 439/786–791, 797, 798, 908, 817, 819

[56] References Cited

U.S. PATENT DOCUMENTS 1,181,513 5/1916 Ericson ..... 439/817

1,437,103 11/1922 Hengstenberg ..... 439/817

FOREIGN PATENT DOCUMENTS 827669 1/1952 Fed. Rep. of Germany ..... 439/798

*Primary Examiner*—David L. Pirlot

*Attorney, Agent, or Firm*—Richard S. Erbe

[57] ABSTRACT

An improved electrical connector for use in pyrotechnic displays. The connector uses a single piece conductor pin, a clamp and a spring. Wires from a pyrotechnic projectile are attached to the connector by pushing down on the clamp and compressing the spring, providing an opening in which bare wire may be placed. Releasing the clamp causes the spring to extend, thereby securing the wire between the head of the conductor pin and the clamp by spring tension. After the projectile has been launched, a wire may simply be pulled out by the operator without pushing down on the clamp. The improved connector is especially useful where the pyrotechnic devices and associated electric circuitry are mounted on or near the water. Because of its primarily stainless steel structure, the connector is corrosion-resistant. It also provides a watertight seal, preventing the introduction of water to the firing control system circuitry. Individual components of the connector may be replaced as they wear out, obviating the need to discard the entire connector when one part wears out.

2 Claims, 2 Drawing Sheets

FIG. 4
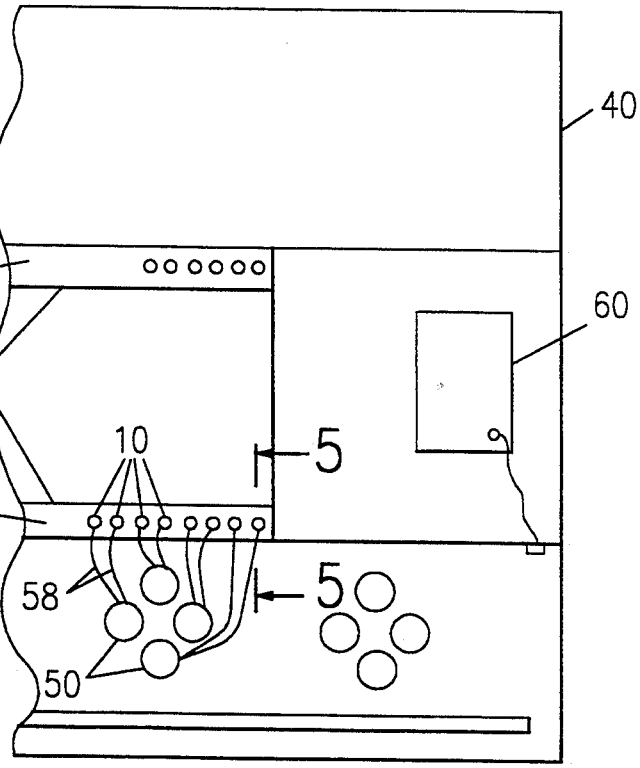
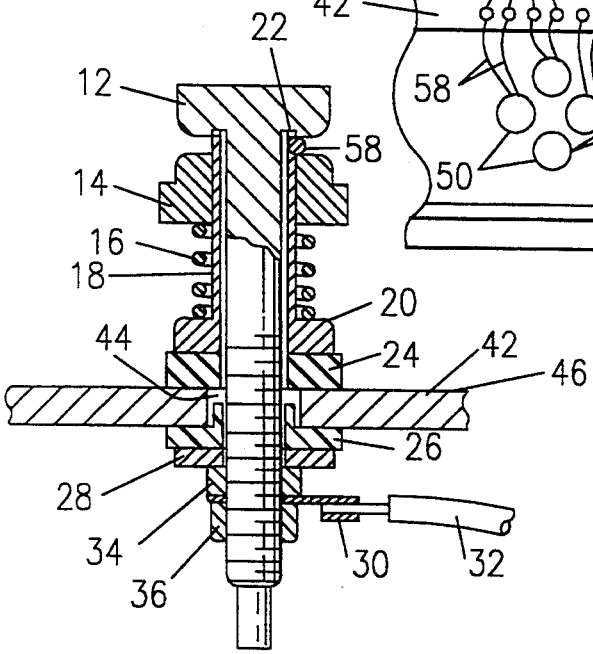
FIG. 5
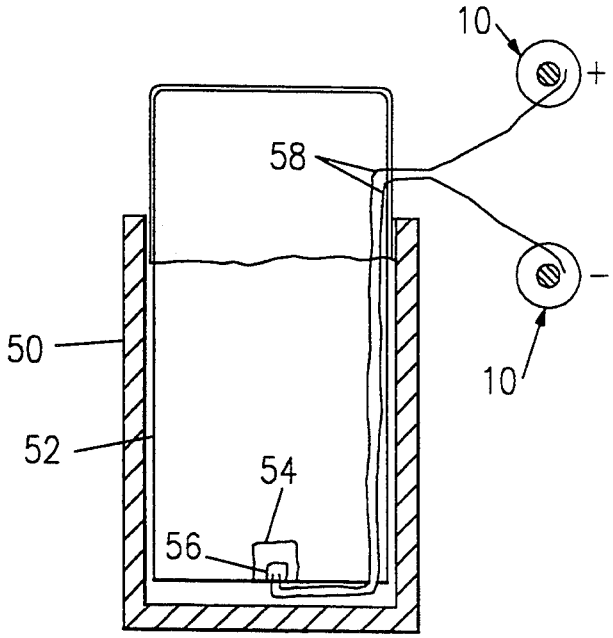
FIG. 6

ELECTRICAL CONNECTOR FOR PYROTECHNIC APPLICATIONS

BACKGROUND OF THE INVENTION

1. Field of the Invention

The present invention relates generally to electrical connectors, and more specifically to devices that may be found in electrical circuitry connecting a pyrotechnic firing system to pyrotechnic projectiles.

2. Description of the Related Art

"Pyrotechnics" is the "science of fire." Almost everyone is familiar with fireworks shows created by exploding pyrotechnic devices. Fireworks displays have been created and enjoyed for centuries by millions of people. Over the years, the systems and methods for creating the displays have remained substantially unchanged.

Fireworks systems in the prior art are comprised essentially of two main components, namely a pyrotechnic projectile and a mortar for directing the pyrotechnic projectile into the air. The pyrotechnic projectile itself consists of two principal components, comprising an initial burst and a main burst. Black powder is one of the oldest pyrotechnic propulsion agents and is typically used as the initial burst and main burst component. The main burst also includes pellets of color composition known as "stars." Igniting the stars during detonation of the main burst provides the light and color of the fireworks display.

A pyrotechnic projectile has two fuses in the form of an initial fuse and a main fuse. The main fuse extends from the initial burst in the outer shell of the projectile to the main burst in the inner shell of the projectile. The initial fuse extends from the initial burst to the exterior of the outer shell. By igniting the initial fuse, the initial burst is exploded and propels the pyrotechnic projectile from the mortar into the air. Contemporaneously, the main fuse is lit because the end of the main fuse protrudes into the initial burst. The main fuse then takes a specific time to burn into and ignite the main burst.

A number of methods are known to ignite the initial burst. One such method is to apply a flame to a flammable cord leading to the initial fuse. While this method is simple, it may present safety hazards and is not suitable for more creative and comprehensive fireworks displays that require precise timing and sequencing of a series of fuse ignitions. For these more comprehensive shows, a firing control system, using electrical signals, is commonly employed. Electrical wires are used to connect the initial fuses of multiple pyrotechnic projectiles to the firing control system, which controls the firing sequence of the projectiles in accordance with the fireworks show requirements.

With today's more complex fireworks shows, it is imperative that the components connecting the firing control system and the pyrotechnic projectiles be durable, easy to use for multiple display applications, and easy to replace. Recently, theme parks and other entertainment venues have been providing fireworks displays that are associated with water shows. Often in these situations, the components making up the firing circuits are located in close proximity to water from being mounted on floating barges in a lagoon or lake. For this reason, it is desirable that such components be corrosion-resistant. One vital component of an electric firing circuit in a pyrotechnic display system is the connector that connects the wiring from the firing control system to the wiring of the initial fuses in the projectiles. Where the pyrotechnic system is exposed to water, it is not only important that the connecting device be durable, easy to use and corrosion-resistant, it should also provide a tight seal to prevent shorting of the electrical components in the firing control system caused by contact with water.

Connectors that have been found to be suitable for use with land-based fireworks displays include the Admiral "ADLOC AL2000" and the "Kingspin." While suited for such applications, these connectors have drawbacks when used near or on water. The ADLOC AL2000 does not provide a waterproof seal and allows water to enter the electronics of the firing control system. Leakage into the electronics causes numerous problems: fireworks can unexpectedly explode, causing a danger to personnel working on the systems or show; also, fireworks may fire out of sequence, all at once, or not at all, resulting in very poor quality displays. The ADLOC is also not very durable and cannot withstand the constant impacts associated with barge-based pyrotechnics shows.

The Kingspin is not easy to use. It requires the user to depress the head of the connector to a precise position that exposes an opening into which the end of the wire from a pyrotechnic projectile is inserted. Spring tension resists this pressure, and the user must hold the connector in the proper position until he or she is successful in passing the wire into the opening. This operation may require several tries and can be very time consuming. It is also known that inadvertent impacts during show preparation or operation from equipment or personnel on top of the connector may cause the opening to be exposed and the wiring to be disengaged.

An additional problem with both the Kingspin and the ADLOC AL2000 is that when one component of either connector wears out, gets corroded or otherwise becomes non-usable, the entire connector must be replaced.

From the foregoing description, it should be apparent that there is a need for an electrical connector for use with a pyrotechnic system that is durable and corrosion-resistant. It is also desirable to provide such a device that provides a watertight seal preventing the leakage of water into the firing control system. It is further desirable that such a device be able to withstand frequent contact by operators and equipment without allowing disengagement of wiring. It is yet further desirable to provide such a device that is easy to use in single applications as well as for multiple show applications. It is still further desirable to provide such a device where individual components may be replaced as required while being able to continue use of those components of the device that are still in usable condition. It is yet further desirable to provide such a device that can replace existing devices without requiring that any special modifications or accommodations be made to existing facilities. The present invention satisfies these needs and provides further related advantages.

SUMMARY OF THE INVENTION

The just-described problems of the prior art are addressed and solved by the present invention. In particular, the present invention provides an improved electrical connector which is durable, easy to use, corrosion-resistant, provides a watertight seal in water-based applications, provides a secure electrical connection, and has easily replaceable components. These capabilities are believed to advance the art significantly.

These results are achieved by providing a connector having a single conductor pin inserted in a clamp, a spring and a one piece tube and flange. Washers and nuts are provided where applicable to provide a strong, durable, yet easy to use connector. To secure a wire from a pyrotechnic projectile to the connector, the clamp is pushed away from the head of the conductor pin against the spring by the user, using his or her finger, exposing the tube. The clamp has a knurled surface to enable the user to easily depress it using a finger. The wire is then placed against the tube and the clamp is released. Releasing the clamp causes the spring to extend and the clamp to move towards the head of the conductor pin. The result is a very secure connection of the wire to the connector using the tension of the spring.

Alternatively, the wire may be secured to the connector without pushing on the clamp. This is done by having the user place a wire between the radiused edges of the clamp and the conductor pin head and pulling or pushing the wire into place.

The knurled surface of the clamp also enables the user to attach wires to the connector using only one hand. This is particularly advantageous when the connectors are mounted on a barge, because the user frequently must attach the wires while he or she is in a boat and needs to use one hand for support.

Because the head of the conductor pin is not movable, impacts on the connector head by a tool or from an operator stepping on it will not cause wires to become disconnected, as is possible with prior art connectors. The one piece tube and flange provides further structural strength to the connector by protecting the conductor pin from impacts.

An important aspect of the present invention is the capability of the invention to provide a watertight seal where the pyrotechnic equipment is mounted on a structure that is on or near a body of water. A watertight seal is critical in keeping the firing system electronics from being exposed to water, which could cause shorting and other adverse effects to the system. Connectors in the prior art, because they require exposure of openings in order to facilitate connecting of wires from the pyrotechnic projectiles to the firing system, are susceptible to leakage of water through these openings. The present invention has no such openings and thus does not afford the opportunity for water to enter the firing system electronics and cause shorting.

Another significant advantage provided by the present invention is in its ease of use, both in connecting and disconnecting the wiring from the pyrotechnic projectiles. Connection of wires to the connector has been described earlier. This operation does not require precise placement of the wire through a small opening as with the prior art connectors, nor does it require the use of tools of any kind. Release of the wire from the present invention after the pyrotechnic projectile has been launched may be accomplished by depressing the clamp and freeing the wire, or the operator may simply pull on several wires at once, causing the wires to slide out of their secured positions. This feature of the present invention is especially useful in applications where a quick changeover of the fireworks show to the next show is required. This feature provides yet an additional advantage in that spring life is extended, because the spring does not need to be repeatedly compressed and extended as with connectors in the prior art.

Another important advantage provided by the present invention is the ability to replace its individual components, such as, for example, the spring, when they wear out or otherwise become unusable. In the prior art connectors, when any one component becomes unusable, the entire connector must be discarded and replaced in its entirety, thus making maintenance of the facility expensive. With the present invention, loosening of a nut allows quick disassembly of the connector. The unwanted part, whether it is a washer, spring, clamp, or other part, can be discarded and replaced. The original assembly with the replacement part can be quickly reassembled and put back into use in the facility.

A further important advantage provided by the present invention is its corrosion-resistant construction. This feature is especially advantageous in applications where the connector is exposed to water. Many prior art connectors do not have this feature and so are subject to corrosion when exposed to water.

A further advantage provided by the present invention is that it does not require that modifications be made to existing pyrotechnic show structures. The present invention was designed to fit into the same opening and other structural features as the prior art connectors.

Other features and advantages of the invention should be apparent from the following description of the preferred embodiment, taken in conjunction with the accompanying drawings, which illustrate, by way of example, the principles of the invention.

BRIEF DESCRIPTION OF THE DRAWINGS

An electrical connector, constructed in accordance with the preferred embodiment of the invention, is illustrated in the accompanying drawings in which:

FIG. 4 is a plan view of a floating barge showing the arrangement of the present invention in relation to the barge, pyrotechnic projectiles, and firing system.

FIG. 5 is a sectional side view at section 5—5 of FIG. 4 showing an apparatus in accordance with the present invention mounted to the barge.

FIG. 6 is a side view of a pyrotechnic projectile tube with a projectile inside it and the wiring to the an apparatus of the present invention.

DETAILED DESCRIPTION OF THE PREFERRED EMBODIMENT

Figure 1:
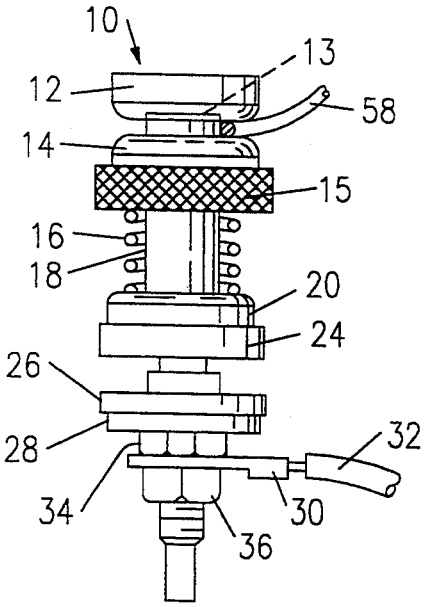
FIG. 1 is a side view of an apparatus in accordance with the present invention, showing the spring in its extended position, thereby clamping the lead wire from a pyrotechnic device.
Figure 2:
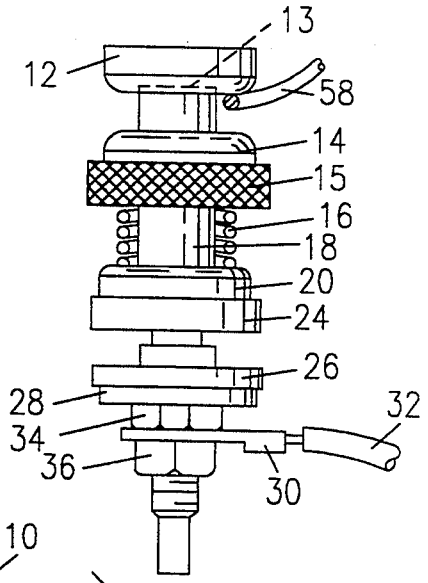
FIG. 2 is a side elevational view of an apparatus in accordance with the present invention, showing the spring in its compressed position, thereby allowing the lead wire from a pyrotechnic device to be connected or released.
Figure 3:
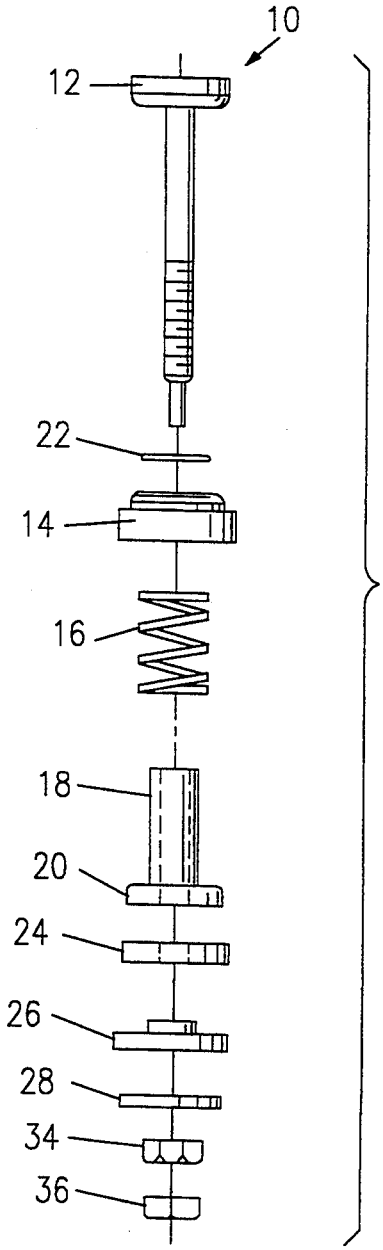
FIG. 3 is an exploded view of an apparatus in accordance with the present invention, showing the conductor pin, clamp, spring, tube, flange, washers and nuts.

An electrical connector according to the preferred embodiment of the invention, generally referred to by the reference numeral 10, utilizes a conductor pin 12 inserted in a clamp 14, a spring 16 and a tube 18 (FIGS. 1, 2, and 3). An operator (not shown) of a pyrotechnic show uses a plurality of the connectors as circuit elements completing the connections between pyrotechnic projectiles and a firing control system for launching the projectiles. Attachment of wires to the connector is easy. A wire 58 from a projectile 52 is secured to the connector by applying downward pressure on clamp 14 and spring 16. This action causes spring 16 to compress, exposing a portion of tube 18 (FIG. 2). Wire 58 is placed adjacent to the tube and the downward force is then removed, causing clamp 14 to be forced upward against wire 58 by the extension of spring 16. When spring 16 is fully extended, wire 58 is secured tightly between clamp 14 and conductor pin 12 (FIG. 1).

Alternatively, the operator may grasp the wire in two places and hold it adjacent to the point where the top side of clamp 14 abuts the lower side of the head of conductor pin 12 and pull or push the wire until it is secured between the clamp 14 and conductor pin 12. The top side of the clamp and the bottom side of the head of the conductor pin are radiused so that this simple method of attaching a wire to the connector may be accomplished. Thus, a wire from a pyrotechnic projectile may be connected to the connector 10 without having to touch or otherwise have contact with it. The circuit is completed by attaching a wire 32 from the firing control system to the connector.

The knurled surface 15 of clamp 14 provides a further advantage in that it allows the operator to attach wires to the connectors by using only one hand. In many applications, the operator needs to use one hand for support, so only one hand is available for wire attachment. To attach a wire 58 to connector 10 using only one hand, the operator grasps wire 58 between the thumb and forefinger of the hand, leaving the exposed (stripped) end of the wire free. Using the thumb and middle finger of the hand to push down on the knurled surface 15 of clamp 14, the exposed end of the wire may be place adjacent to tube 18. Clamp 14 is then released, resulting in the attachment of the wire to the connector.

A very significant aspect of the present invention lies in its ability to provide a watertight seal in an application where the firing control system, the projectiles, and the connectors are mounted on or near a body of water, such as on a floating barge 40 (FIG. 4). Floating barge 40 includes watertight boxes 46. Connector 10 mounts to the mounting surface 42 of a watertight box 46 through opening 44 (FIG. 5). Washers 24 and 26 are adjacent to the upper side and lower side, respectively, of mounting surface 42 and prevent water from flowing through opening 44 and into watertight box 46. The upper end of tube 18 comes in tight contact with washer 22, as will shortly be described in more detail, preventing the flow of water through it to the system electronics.

Another important aspect of the present invention is its ability to provide a secure electrical connection even when it is impacted by tools or other objects or is stepped on by operating personnel. Due to the structural relationship between the tube 18 and the conductor pin 12, the conductor pin cannot be displaced when providing a connection between wire 58 and connector 10, impact on the conductor pin by tools, objects, or personnel cannot cause displacement of clamp 14 or spring 16, thus preventing wire 58 from becoming disconnected from connector 10.

I will now describe the structure of the electrical connector in greater detail.

With reference to FIG. 3, in particular, the connector includes a single piece conductor pin 12, which is threaded at its lower end, clamp 14, spring 16, tube 18, and flange 20. Tube 18 and flange 20 are constructed as a single unit, which adds to the durability of the connector by enabling conductor pin 12 to better withstand impacts from tools, objects, or personnel. The underside of the head of conductor pin 12 contains groove 13 into which is inserted washer 22. When the assembly is completed, the upper end of tube 18 fits tightly into groove 13 against washer 22, which enhances the ability of the connector to withstand impacts and provide a tight seal.

Washers 24, 26, and 28 are included as shown to provide tight interfaces between parts and to provide a watertight seal where required. Of particular note is washer 24, which in the preferred embodiment is configured as a nitrile washer, having the characteristics of being resistant to ultraviolet rays and ozone. Washer 24 has a Shore strength rating in the range of 80 to 85 and can withstand high torques without being deformed. With its strength and durability characteristics, washer 24 is a key component in a connector that is durable and provides a watertight seal.

The entire assembly of connector 10 is held together by nut 34. Nut 36 provides a means of securing wire 32 from the firing control system to the connector. Eyelet 30 at the end of wire 32 fits over the lower end of conductor pin 12 and is secured between nuts 34 and 36.

It should be noted that repair or replacement of any parts of connector 10 can be accomplished easily. Removal of nuts 34 and 36 allows disassembly of the connector structure for rapid part replacement and maintenance. Rapid reassembly of the structure is also easily accomplished.

In the preferred embodiment of the invention, conductor pin 12, clamp 14, spring 16, tube 18, flange 20, washer 28, and nuts 32 and 34 are fabricated from stainless steel, enhancing the durability of connector 10 and enabling the present invention to be corrosion-resistant.

The present invention, while having utility in a wide variety of applications requiring durable electrical circuitry, is especially suitable for pyrotechnic applications where the firing control circuitry and the pyrotechnic projectiles are located on or adjacent to a body of water. FIG. 4 illustrates such an application, where a plurality of connectors 10 are attached to watertight boxes 46 and to a plurality of projectiles 52 by wires 58, and to firing control system 60 by wires 32.

FIG. 5 illustrates how connector 10 is mounted to mounting surface 42 and provides a watertight seal in a water based application. Conductor pin 12 and washer 22 are inserted into clamp 14, spring 16, and then tube 18 and flange 20. Washer 24 fits over the lower end of conductor pin 12 and is adjacent to flange 20. This partial assembly is placed on the upper side of mounting surface 42 with the lower end of conductor pin 12 inserted into opening 44 in mounting surface 42. Opening 44 is 5/16" in diameter, which is standard for this type of application. The lower side of washer 24 abuts the upper side of mounting surface 42. Washer 26, which is preferably a shoulder washer, is fitted over the lower end of conductor pin 12 and abuts the lower side of mounting surface 42. Washer 28 and nut 34 are fitted over the lower end of conductor pin 12, with the upper side of washer 28 adjacent to the lower side of washer 26. Nut 34 is tightened against washer 28 to secure the connector 10 to the mounting surface 42. Tightening of nut 34 forces tube 18 upward and the head of conductor pin downward, compressing washer 22; at the same time, flange 20 is forced tightly against washer 24, which is forced against mounting surface 42, resulting in a sealing off of any potential moisture paths and providing a watertight seal in the watertight boxes.

FIG. 6 illustrates the interconnection of projectile 52 to the present invention. Projectile 52 is positioned inside projectile launch tube 50 in preparation for launch. Projectile 52 contains initial fuse 54. The ignition of initial fuse 54 launches projectile 52 and ignites the main fuse (not shown). Within initial fuse 54 is electronic match 56, which contains wires 58. Wires 58 are attached to connectors 10, one wire to a connector operating as a positive terminal, the other wire to a connector operating as negative terminal. Each connector 10 is connected to firing control system 60 by a wire 32.

To launch projectile 52, firing control system 60 creates a voltage differential across electronic match 56, igniting initial fuse 54, thus causing expulsion of projectile 52 from projectile launch tube 50.

The present invention has been described above in terms of a presently preferred embodiment so that an understanding of the invention can be conveyed. There are, however, many configurations for electrical connectors not specifically described herein, but with which the present invention is applicable. The present invention should therefore not be seen as limited to the particular embodiment described herein, rather, it should be understood that the present invention has wide applicability with respect to electrical circuits. Such other configurations can be achieved by those skilled in the art in view of the description herein. Accordingly, the scope of the invention is defined by the following claims.

I claim:

1. An apparatus for connecting the fuse of a pyrotechnic projectile to a firing control system, the apparatus comprising:

a one piece tube and flange having an upper end and an opposed flanged lower end;

a spring sized to fit over the upper end of the tube and flange;

a clamp having an upper side and a lower side and further having an opening adapted to fit over the upper end of the tube and flange;

a conductor pin having an upper end and an opposed lower end, said upper end having a head, said lower end sized to fit within said tube and flange; and a groove in said head of said conductor pin, said groove sized to receive said upper end of said tube.

2. An apparatus for connecting the fuse of a pyrotechnic projectile to a firing control system, the apparatus comprising:

a one piece tube and flange having an upper end and an opposed flanged lower end;

a spring sized to fit over the upper end of the tube and flange;

a clamp having an upper side and a lower side and further having an opening adapted to fit over the upper end of the tube and flange;

a conductor pin having an upper end and an opposed lower end, said upper end having a head, said lower end sized to fit within said tube and flange; and a plurality of washers, each said washer having an opening adapted to fit over said lower end of said conductor pin;

a nut having an opening sized to fit over said lower end of said conductor pin; and a groove in said head of said conductor pin, said groove sized to receive said upper end of said tube.

* * * * *